United States Patent [19]

Knappstein et al.

[11] 4,167,453

[45] Sep. 11, 1979

[54] REGENERATOR LINING FOR REGENERATOR CHAMBER CELLS IN COKE OVENS

[75] Inventors: Johannes Knappstein; Friedrich Thiersch; Werner Schuch, all of Recklinghausen, Fed. Rep. of Germany; Rolf Weber, Hamilton, Canada; Kurt-Günther Beck, Essen, Bredeney; Dieter Stahlherm, Recklinghausen, both of Fed. Rep. of Germany

[73] Assignee: Firma Carl Still, Recklinghausen, and Bergwerksverband GmbH, Fed. Rep. of Germany

[21] Appl. No.: 581,555

[22] Filed: May 28, 1975

[30] Foreign Application Priority Data

May 30, 1974 [DE] Fed. Rep. of Germany ..... 2425931

[51] Int. Cl.[2] ..... C10B 1/06; C10B 5/12

[52] U.S. Cl. ..... 202/141

[58] Field of Search ..... 202/141–146, 202/248

[56] References Cited

U.S. PATENT DOCUMENTS

| | | | |
|---|---|---|---|
| 2,334,612 | 11/1943 | Davis | 202/141 |
| 3,838,017 | 9/1974 | Messerschmidt | 202/141 |

FOREIGN PATENT DOCUMENTS

| | | | |
|---|---|---|---|
| 1226073 | 10/1966 | Fed. Rep. of Germany . | |
| 2016410 | 12/1971 | Fed. Rep. of Germany | 202/141 |

*Primary Examiner*—Robert H. Spitzer
*Attorney, Agent, or Firm*—McGlew and Tuttle

[57] ABSTRACT

A regenerator lining for regenerator chamber cells in coke ovens, comprises a stone or brickwork having either a honeycomb or lamellar structure, with a plurality of gas passages extending therethrough and terminating in openings on the top and bottom sides of the structure. The transverse portions or sides are made of frame portions having a material thickness of up to 20mm. The webs or spacing between the openings is up to 10mm in thickness. In the case of circular, hexagonal, or similar shape passages, the openings have diameters of up to 16mm and in a construction which includes a slot formation, the slots are made up to 16mm wide.

6 Claims, 4 Drawing Figures

REGENERATOR LINING FOR REGENERATOR CHAMBER CELLS IN COKE OVENS

FIELD AND BACKGROUND OF THE INVENTION

This invention relates in general to the construction of regenerator linings and, in particular, to a new and useful regenerator lining for regenerator chamber cells in coke ovens, which is made of stones or brick elements having a honeycomb or lamellar structure and with internal gas passages and which comprises a frame portion and a network of webs or a plurality of lamellae which are arranged to limit the widths of channels or slots.

DESCRIPTION OF THE PRIOR ART

There has been an increased demand in recent times for ever increasing throughput capacities of coke ovens. Such an increase in throughput capacity requires an increase of the volumes of the heating gases and air for combustion and this requires a higher performance of the regenerators and a more efficient use of the heating gases or waste heat combustion gases in order to prevent the reduction of the economic operation of the ovens. Generally higher performances of regenerators can be obtained in two ways, namely:

1. By increasing the volume of the regenerators; and
2. By increasing the heat absorption and transmission with an unchanged volume of the regenerators.

It is well-known in the art that while increasing the throughput of oven chambers by 65%, the regenerator volume must be increased by 50%, and for an increase of 150%, an increase in the regenerator volume of 110% becomes necessary. This reduces the ratio of the useful height of the oven chamber to the height of the regenerator space from 1.5 down to 0.7, and this means that the proportional costs for the regenerators rise. This is contrary to a requirement for reducing the capital investment in the construction of new coke oven batteries and this is described, for example, in "Technological Program of Development of Horizontal-Chamber Coke Ovens," a lecture by K. G. Beck at a meeting of the "Technology and Development of Stone Coal Coking" which was held by the Commission of European Communities on Apr. 23 and 24, 1970 in Luxembourg.

Attempts have already been made to raise the specific volume performance of regenerators. In general, this performance increases with the increasing lining mass and with the diminution of the free regenerator volume and, inversely, it decreases with the decrease of the lining mass and with the increase of the free regenerator volume. The limits are set to the diminution of the free regenerator volume by the fact that with the volume reduction, the resistance to gas flow increases inadmissibly. This is why the cross-sectional areas in regenerators cannot be reduced arbitrarily, nor can the slots and channels be narrowed at will. Inversely, the heat absorbing mass of the regenerator lining cannot be increased indiscriminately. In addition, the gases which flow through the regenerators, including air and particularly lean gas are not dust-free, and there is the danger that the dust will deposit on the lining to an inadmissible extent and thus reduce the passages which would again increase the flow resistance and contribute to the diminished heat transmission.

German Pat. No. 1,226,073 discloses a horizontal chamber coke oven with a regenerative heat exchange, in which the regenerator cells of the regenerator chambers are replaceably mounted between two pairs of intermediate supporting walls of heat resisting steel and the lattice work of the regenerator cells is formed by up to 12 mm thick lattice bars having from 5 to 8 mm spaces therebetween. In such a design, the regenerator cells may be surrounded laterally by metal cases immediately adjacent the bottom flues. These are also provided with a metal casing in the form of pressure-resistant metallic tubes having a square cross-section. A direct communication between the bottom flues and the cells is established through adjustable openings and the metal cases of the regenerator cells may be provided with cleaning ports which may be manipulated from below, and which serve also as air supply flaps. Such constructions include hermetically closable openings which are suitably dimensioned for the mounting and dismounting of the lattice insert. With such a design of regenerators, a particularly uniform heating of the oven chambers is obtained in accordance with one objective and the resulting times required for realignment are between from 5 to 15 minutes. At the same time, because of the narrow passageways and the small material thicknesses of the lattice bars, the specific volume performance of the regenerators is increased and a reduction of the regenerator space is made possible, that is, the ratio of the useful height of the oven chambers to the height of the regenerators becomes a favorable value.

In this known design, however, the regenerator lining or its lattice work comprises only lattice bars and the mounting of the bars in the regenerator cells requires special retention frames with internal guide spacers between which the lattice bars are introduced along with double walls, foot strips, and supporting plates of various dimensions. Thus, to equip the regenerators, numerous individual stone pieces or brick pieces are necessary and they must be arranged so as to permit an easy dismounting and replacement of the regenerator cells themselves, including their linings, and also the individual lattice bars along with the retention means, which must be done as soon as the gas passage becomes hindered by dust deposits. All of these individual parts with the corresponding number of brick molds and the structural measures which ensure the replaceability of the regenerator cells, make the known constructions relatively expensive.

SUMMARY OF THE INVENTION

The present invention provides a regenerator lining of honeycomb and lamellar stones for coke oven batteries having high throughputs and a favorable oven-chamber to regenerator height ratio and which is of a simple construction. In accordance with the invention, a regenerator lining is used which is made of honeycomb and lamellar stones which comprise frame portions having a thickness of up to 20 mm and webs or lamellae having a thickness of up to 10 mm and are provided with channels and slots which have a diameter and width of up to 16 mm. Such honeycomb or lamellar stones or bricks may be made of any material which is usual for this high temperature purpose, such as, fire clay, and such high quality materials which are on the market under names, such as SILIKA, MULLIT, SILLIMANIT, or the like.

The stones or bricks may be provided in a well-known manner with foot supports or foot strips and they can be superposed in the regenerator cells so as to form through passages constituted by the channels or slots. For a finished lining of the regenerator chambers, it is sufficient to use a single type of stone or brick and in particular cases, however, both honeycomb and lamellar stones may be used, for example.

It has been found through the operation of regenerators with the inventive arrangement that no particular measures are necessary to ensure an easy and quick replacement of the cells. Surprisingly, the relatively narrow gas passageways are neither offset relative to each other nor narrowed so as to reduce any heat transmission. To simplify the mounting, it is recommended that the honeycomb or lamellar stones be assembled in case-bays before placing them in an assembled state in position in the regenerator chambers. No particular measures are necessary for connecting the regenerator chambers to the bottom flues and the heating flues of the heating walls.

The inventive honeycomb and lamellar stones have proven to be not particularly sensitive to handling, in spite of the small material thicknesses. Their manufacture requires only a little more care than is usual with refractory blocks which have been used heretofore in coking technology. They may be made of dimensions of from 200 to 400 mm long, and from 200 to 400 mm wide and from 100 to 200 mm high, and they may be provided with intermediate walls. The cross-section of the channels in the honeycomb stones may be circular, oval and polygonal, for example, square or hexagonal.

Honeycomb and lamellar stones having channels and slots with diameters or widths comparable to those in accordance with the invention have heretofore had a substantially greater material thickness so that the known stones have a specific ratio of the surface participating in the heat exchange to the stone mass of approximately 0.04 $m^2/kg$. The inventive stones have values which amount to from 0.08 to 0.12 $m^2/kg$, and preferably, 0.10 $m^2/kg$, thus being approximately two to three times higher and, consequently, substantially more favorable for the heat absorption and transmission of the material. For this reason, with the use of stones or bricks constructed in accordance with the prior art, substantially longer heat absorption and transmission periods are necessary, while the use of stones or bricks of the inventive design results in the advantage of a short period requirement for reinstalling the brickwork and also in a uniform heating which is effected by the construction.

Intentionally, the invention does not follow the principle which has been adhered to in coking technology up to the present time, that is, to have the greatest possible stone mass placed in the regenerator in order to obtain a heat absorbing capacity as large as possible. The invention rather seeks to approximate the known recuperator principle and manages with substantially smaller exchange masses and lower regenerators so that relative to the known constructions, at least 30% of the stone masses are saved.

In the chemical industry, similar stone blocks may be employed which have substantially smaller dimensions, for example, 90×40×40 mm, with substantially narrower passages, as well as with very small material thicknesses. In this application, however, such brickwork does not function for heat exchange but are used as catalyst supports and are made of alumina. Moreover, the field of catalytic chemistry is very remote from the heating of coke oven plants so that the solution of the problem underlying the present invention cannot be considered obvious in respect to the chemical industry devices.

Accordingly, it is an object of the invention to provide a regenerator lining for regenerator chamber cells in coke ovens which comprises a stone or brickwork having a honeycomb or lamellar structure with a plurality of gas passages extending therethrough and having side frame portions and top and bottom surfaces with openings for the gas passages and wherein the frame portions have a material thickness of up to 20 mm, and the wall formations between openings are of up to 10 mm in thickness, with the passages and openings being of up to 16 mm wide.

A further object of the invention is to provide a regenerator lining for regenerator chamber cells in coke ovens which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
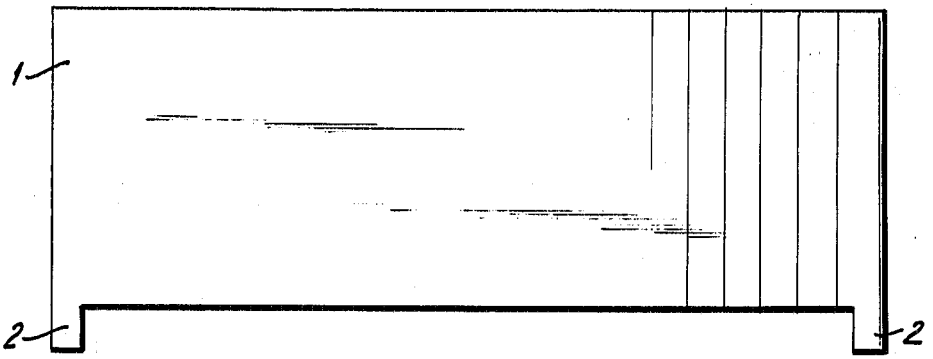
FIG. 1 is a front elevational view of a honeycomb-type brickwork constructed in accordance with the invention.
Figure 2:
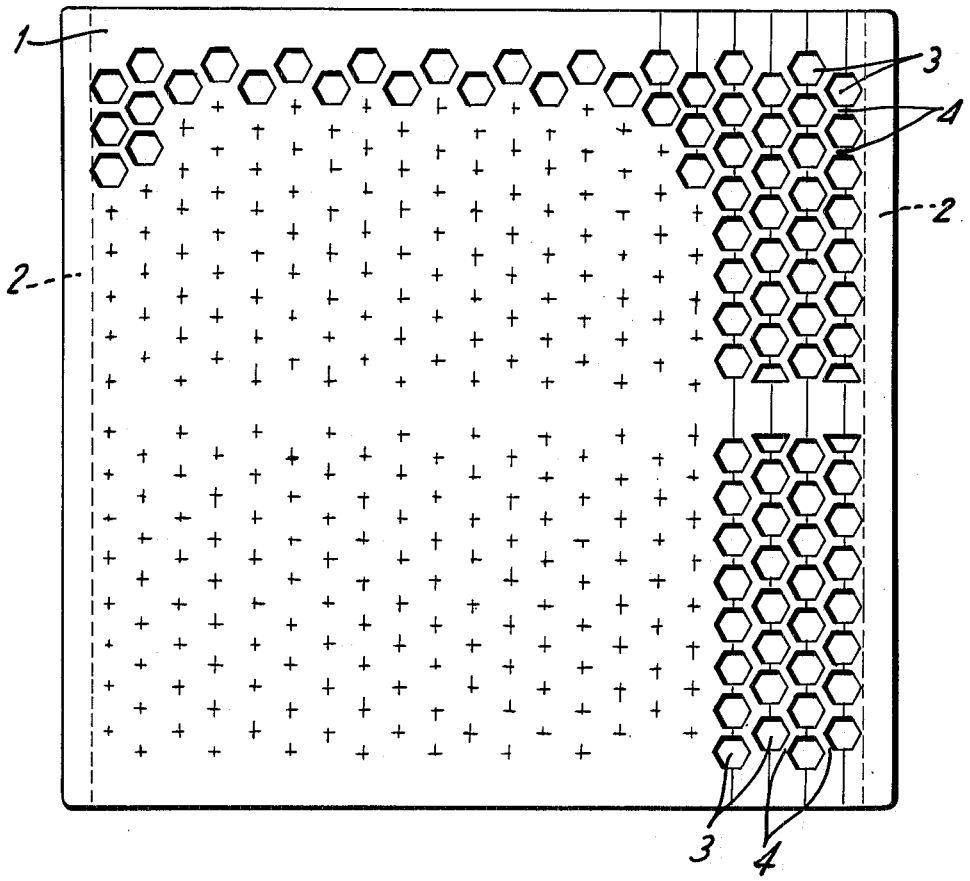
FIG. 2 is a top plan view of the brickwork shown in FIG. 1.

Referring to the drawings in particular, the invention embodied therein in FIGS. 1 and 2, comprises a honeycomb stone or brickwork with transverse frame portions 1 which have foot strips or legs 2. The material thickness of each frame portion does not exceed 20 mm. The brickwork or stone is provided with channels or passages 3 which have a maximum width of 15.1 mm. The webs or formations 4 between the channels or openings for the channels are about 4.5 mm thick. The external dimensions of the brickwork are 375×324×163 mm.

Figure 3:
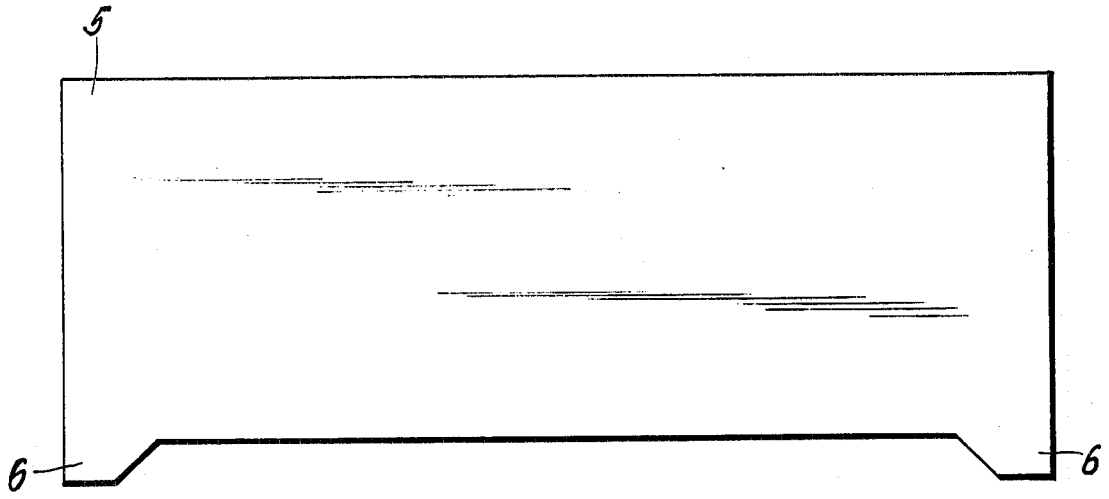
FIG. 3 is a front elevational view of another embodiment of brickwork made of lamellar stone.
Figure 4:
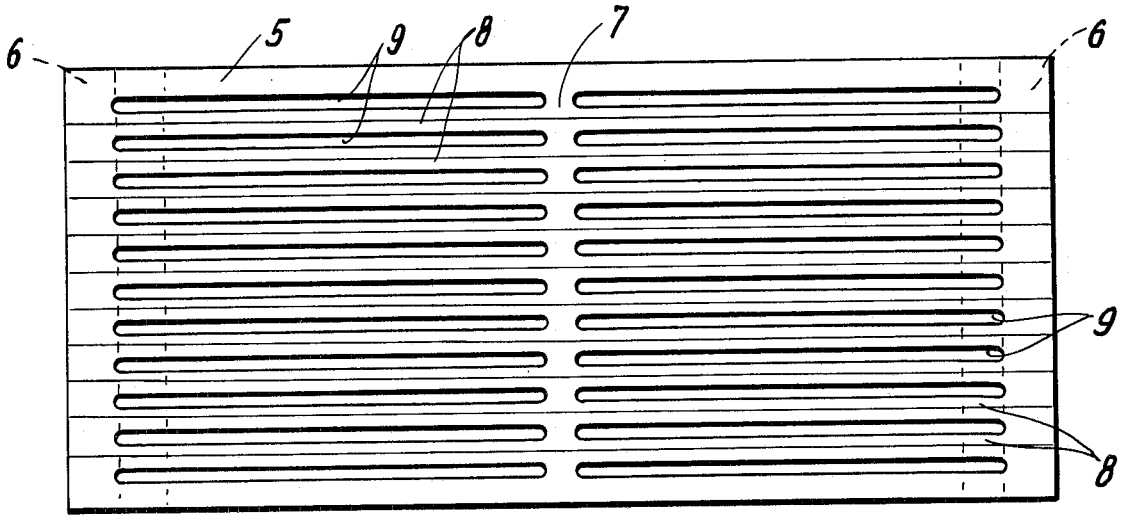
FIG. 4 is a top plan view of the brickwork shown in FIG. 3.

In the construction shown in FIGS. 3 and 4, there is provided a lamellar stone or brickwork which comprises transverse frame portions 5 having foot strips or support feet 6 and an intermediate wall 7 between elongated slots 9. The lamellae 8 defines spaces between the slots 9. The material thickness of the frame portion and the intermediate wall does not exceed 18 mm. The lamellae are 8.0 mm thick and the slots are 5 mm wide.

While specific embodiments of the invention have been shown and described in detail to illustrate the application of the principles of the invention, it will be understood that the invention may be embodied otherwise without departing from such principles.

What is claimed is:

1. A regenerator lining for regenerator chamber cells in coke ovens, comprising a stone having a plurality of internal gas passages extending therethrough and side frame portions and top and bottom surfaces with openings for the gas passages and including wall formations between the openings, said frame portions having a material thickness of up to 20 mm, said wall formations between openings being up to 10 mm in thickness and said passages and openings being up to 16 mm wide and no less than a size to permit flow the gases therethrough, the specific ratio of the stone surface participating in the heat exchange to the stone mass total is from 0.08 to 0.12 $m^2$ of stone surface per kilogram of stone mass.

2. A regenerator lining for regenerator chamber cells in coke ovens, according to claim 1, wherein the cross-section of said openings is circular.

3. A regenerator lining for regenerator chamber cells in coke ovens, according to claim 1, wherein the cross-section of said openings is in the form of elongated narrow slots.

4. A regenerator lining for regenerator chamber cells in coke ovens, according to claim 1, wherein said frame portions are provided with foot portions.

5. A regenerator lining for regenerator chamber cells in coke ovens, according to claim 1, wherein said stones are mounted in modular case-bays.

6. A regenerator lining for regenerator chamber cells in coke ovens, according to claim 1, wherein said stones have lengths of from 200 to 400 mm, widths of from 200 to 400 mm, and heights of from 100 to 200 mm.

* * * * *